US010363745B2

(12) United States Patent
Clark et al.

(10) Patent No.: US 10,363,745 B2
(45) Date of Patent: Jul. 30, 2019

(54) PRINTHEADS WITH PRESSURE EQUALIZATION

(71) Applicant: Hewlett-Packard Development Company, L.P., Houston, TX (US)

(72) Inventors: Garrett E. Clark, Corvallis, OR (US); Michael W. Cumbie, Corvallis, OR (US); Mark H. MacKenzie, Vancouver, WA (US)

(73) Assignee: HEWLETT -PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/772,358

(22) PCT Filed: Feb. 5, 2016

(86) PCT No.: PCT/US2016/016683
§ 371 (c)(1),
(2) Date: Apr. 30, 2018

(87) PCT Pub. No.: WO2017/135959
PCT Pub. Date: Aug. 10, 2017

(65) Prior Publication Data

US 2018/0311959 A1 Nov. 1, 2018

(51) Int. Cl.
*B41J 2/155* (2006.01)
*B41J 2/14* (2006.01)
*B41J 2/175* (2006.01)

(52) U.S. Cl.
CPC ..... *B41J 2/155* (2013.01); *B41J 2/14* (2013.01); *B41J 2/175* (2013.01); *B41J 2/17513* (2013.01); *B41J 2/17566* (2013.01); *B41J 2/17596* (2013.01); *B41J 2002/14419* (2013.01); *B41J 2202/07* (2013.01)

(58) Field of Classification Search
CPC .... B41J 2/155; B41J 2/17566; B41J 2/17596; B41J 2/14; B41J 2/175; B41J 2002/14419; B41J 2202/07
See application file for complete search history.

(56) References Cited

U.S. PATENT DOCUMENTS 5,363,130 A 11/1994 Cowger et al.
6,398,344 B1 6/2002 Silverbrook et al.
6,585,359 B1 7/2003 Gasvoda et al.
(Continued)

FOREIGN PATENT DOCUMENTS

CN 1883946 A 12/2006
CN 101287606 A 10/2008
(Continued)

*Primary Examiner* — Henok D Legesse
(74) *Attorney, Agent, or Firm* — HP Inc. Patent Department

(57) ABSTRACT

Examples described herein include a printhead assembly that includes a housing having a printing material reservoir and a print nozzle array disposed in a side of the housing. The print nozzle array is coupled to the printing material reservoir through a first channel. The printhead assembly can also include a pressure equalization element disposed in the side of the housing and coupled to the printing material reservoir through a second channel to allow air to enter the printing material reservoir when a pressure in the printing material reservoir changes.

19 Claims, 4 Drawing Sheets

(56) References Cited

U.S. PATENT DOCUMENTS

| | | | | |
|---|---|---|---|---|
| 6,793,319 | B2 * | 9/2004 | Ikemoto | B41J 2/1433 347/12 |
| 7,309,121 | B2 * | 12/2007 | Hatasa | B41J 2/17523 347/85 |
| 2005/0007427 | A1 * | 1/2005 | Bellinger | B41J 2/17513 347/86 |
| 2005/0012791 | A1 | 1/2005 | Anderson et al. | |
| 2005/0151801 | A1 | 7/2005 | Neese et al. | |
| 2006/0176347 | A1 | 8/2006 | Hong et al. | |
| 2008/0030538 | A1 | 2/2008 | Kim | |
| 2009/0109268 | A1 | 4/2009 | Yildirim et al. | |
| 2009/0219357 | A1 | 9/2009 | Silverbrook et al. | |
| 2010/0073445 | A1 | 3/2010 | Silverbrook et al. | |
| 2010/0295884 | A1 | 11/2010 | Smektala | |
| 2014/0063113 | A1 | 3/2014 | Irving et al. | |
| 2014/0204148 | A1 * | 7/2014 | Ge | B41J 2/175 347/19 |

FOREIGN PATENT DOCUMENTS

| | | | |
|---|---|---|---|
| CN | 101765510 | | 6/2010 |
| CN | 101903180 | | 12/2010 |
| EP | 1923215 | | 5/2008 |
| TW | 200520973 | A | 7/2005 |
| TW | 200938395 | A | 9/2009 |

* cited by examiner

PRINTHEADS WITH PRESSURE EQUALIZATION

BACKGROUND

Printing devices include systems and devices for applying printing material to media. For instance, some printing devices, such as inkjet printers, use print engines that spray or jet ink or other printing material onto print media. Such print engines, often referred to as inkjets, use thermal or piezoelectric mechanisms to generate carefully timed and spaced droplets of ink to create a printed image. Inkjet printhead dies can be manufactured using various types of mechanical or semiconductor manufacturing and processing techniques. Individual printhead dies can be combined to create larger or wider inkjet printheads, sometimes referred to as page wide arrays.

DETAILED DESCRIPTION

Inkjet printheads can include various mechanisms for applying ink to a media. In some implementations, a printhead can include a jet or sprayer nozzle array formed as an individual inkjet die in a mechanical or semiconductor manufacturing process. Accordingly, the terms "inkjet die" or "die" are used herein interchangeably to refer to any type of thermal or piezoelectric array of nozzles from which ink, or other printing material, can be ejected in a coordinated manner to generate a printed image.

In various implementations, the nozzles in a particular die can be supplied with an ink or printing material from a corresponding reservoir. As used herein, the terms "ink" and "printing material" are used interchangeably to refer to any material that can be ejected from a nozzle or an inkjet die to form or finish a printed image. For example, various colors of ink may ejected by a set of nozzles to generate a printed color image, while a topcoat or curing agent can be ejected by another set of nozzles to cure, protect, or otherwise finish the printed image.

As the nozzles eject printing material, the supply of printing material in the corresponding ink reservoir is depleted. As the printing material is depleted, corresponding back pressure resulting from the decreasing volume of the printing material can cause the printing material to flow less readily and potentially cause false low ink detection signals. To alleviate the back pressure caused by the depletion of the printing material, implementations of the present disclosure include pressure equalization elements that allow air into the printing material reservoir.

In various implementations described herein, the pressure equalization elements can include pressure sensitive valves or surface tension type bubblers (e.g., specifically dimensioned holes) that allow air to enter the printing material reservoir when the back pressure reaches a particular threshold level. In some example implementations described herein, a print nozzle array and a pressure equalization element can be disposed in a common side of a housing that includes a printing material reservoir. In such implementations, the nozzles of the die array can be coupled to the printing material reservoir through one duct or channel, while the pressure equalization element can be coupled to the printing material reservoir through another duct or channel. Accordingly, as air is drawn into the pressure equalization element and through the corresponding duct or channel, the flow of printing material to the nozzles can remain uninterrupted. Specific illustrative example implementations are described in reference to the accompanying figures herein. The examples are meant to be illustrative only and are not intended to limit the present disclosure or the accompanying claims.

Figure 1:
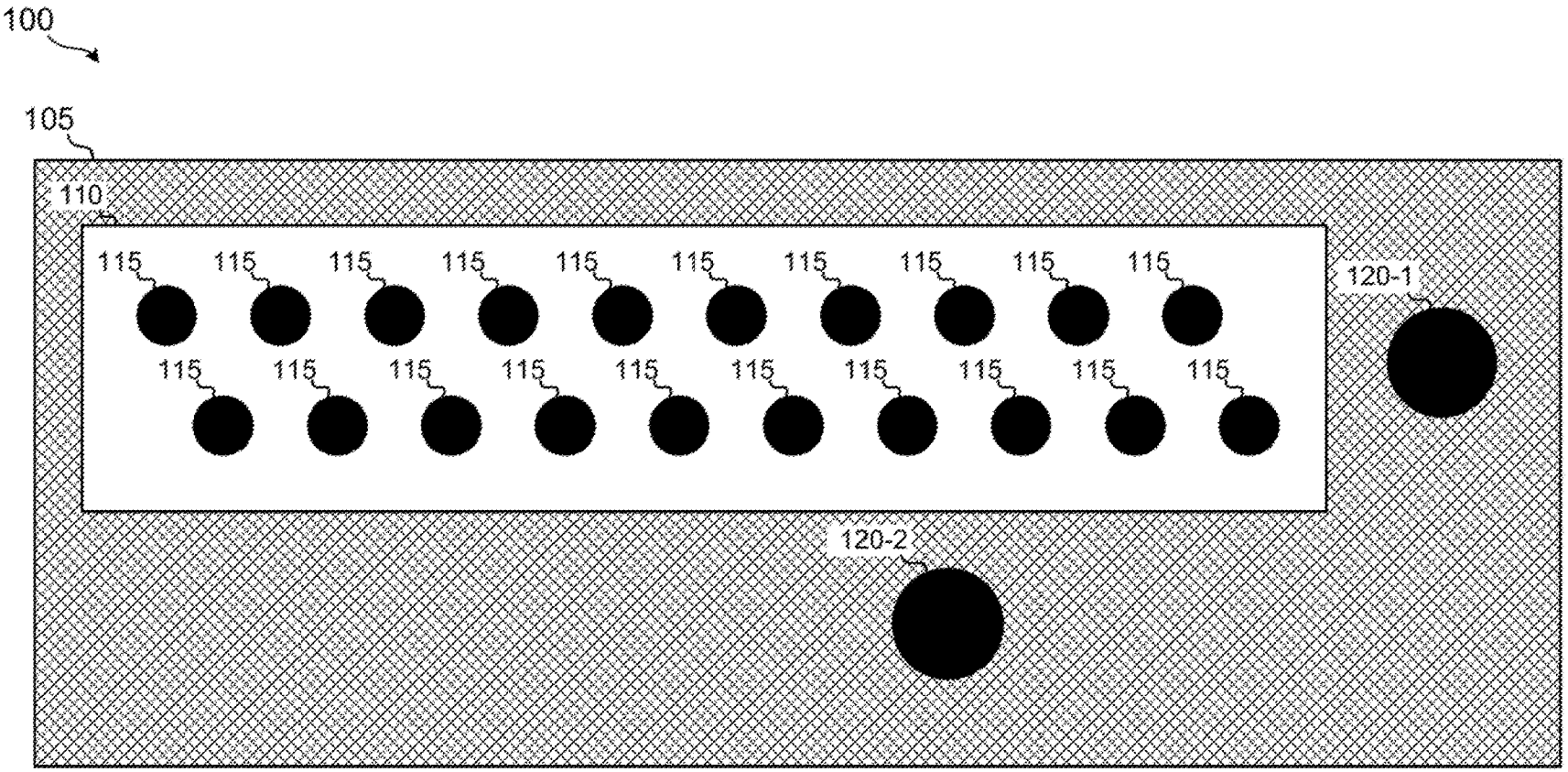
FIG. 1 depicts a schematic of an example over-molded printhead with pressure equalization elements.

FIG. 1 depicts a schematic of a side view 100 of a housing 105 that includes a print nozzle array 110 and pressure equalization elements 120. The aspect of the housing 105 shown can include an over-molded element formed around the print nozzle array 110 to extend the perimeter of the array 110. The housing and the over-molded element can include various moldable materials, such as plastic, composites, metal alloys, and the like. In some example implementations, pressure equalization elements 120 can be formed in the over-molded element or the housing. The housing and the over-molded element can be a single integrated body.

As described herein, the print nozzle array 110 can include an inkjet die that includes an array of multiple print nozzles 115. In some implementations, the print nozzle array 110 can be formed in one process and then joined with the over-molded portion of the housing 105 in another process. The print nozzle array 110 can include various combinations of materials, such as metals, semiconductors, and plastics.

As illustrated, the pressure equalization elements 120 can be disposed in the over-molded portion of the housing 105. Each of the print nozzles 115 and the pressure equalization elements 120 can be coupled to a printing material reservoir in the housing 105 by corresponding ducts or channels (not shown). In various example implementations, the displacement of the pressure equalization elements 120 from the print nozzles 115 can be determined based on the location of the ducts or channels that feed the print nozzles 115 and/or the ducts or channels that couple the pressure equalization elements 120 to the printing material reservoir.

Figure 2:
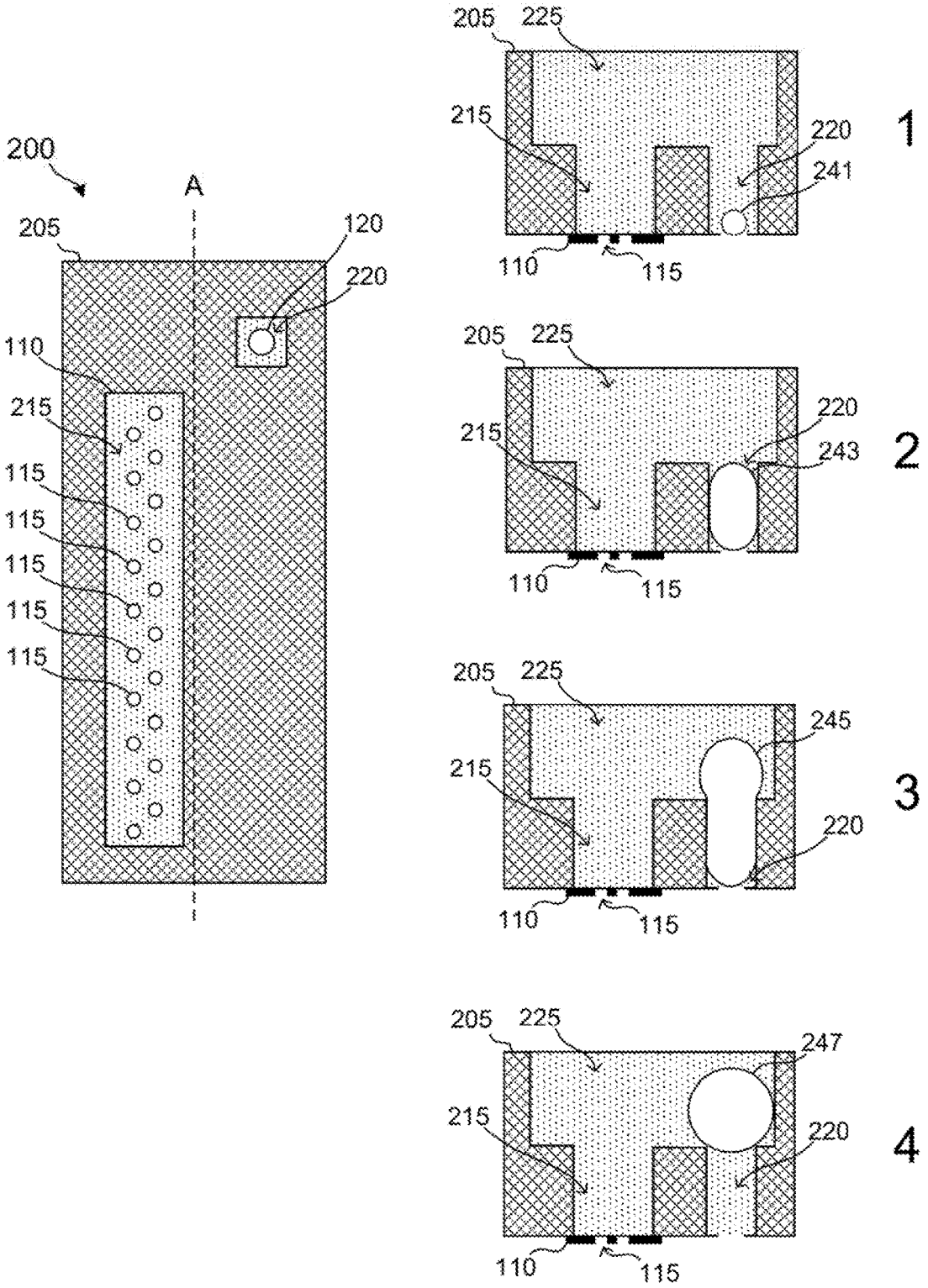
FIG. 2 depicts a schematic and side view of an example over-molded printhead with pressure equalization elements.

FIG. 2 depicts side view 200 of an example housing 205 and corresponding cross-sectional views of an example housing 205 that includes a print nozzle array 110 having an array of print nozzles 115. The cross-sectional views are from the perspective of direction A to illustrate the functionality of example pressure equalization element 120 to allow air into the corresponding printing material reservoir 225 that equalizes the back pressure caused by the depletion of the printing material therein.

As shown, the print nozzles 115 are coupled to the main printing material reservoir 225 by corresponding channel 215. As the print nozzles 115 selectively eject drops of printing material, the level of the printing material in the reservoir 225 is depleted as it flows through the channel 215. To compensate for the back pressure caused by the decreasing volume of the printing material in the printing material reservoir 225, an air can bubble can form in the channel 220 through the pressure equalization element 120. This process is illustrated in steps 1 through 4 in FIG. 2.

At a particular threshold back pressure, the pressure equalization element 120 can begin to allow air, or other gas, to form an initial air bubble 241 within the channel 220 that couples the pressure equalization element 120 to the printing material reservoir 225, as shown at step 1. As more printing material is ejected through the print nozzles 115 in step 2, the air bubble 243 expands to touch the side walls of channel 220. As the bubble 245 increases in size in step 3, it further blocks the channel 220 and moves up into the printing material reservoir 225. In step 4, when the bubble 247 has sufficient volume, buoyancy, or tension to overcome the friction with the walls of the channel 220, it moves into the printing material reservoir 225 to compensate the back pressure due to the depletion of the printing material.

In such implementations, the placement of the pressure equalization element 120 in a position in the housing 205 at a particular distance from the print nozzles 115 can help prevent the occlusion of the channel 215 that could cut off the supply of printing material to the print nozzles 115. In addition, by equalizing the back pressure of the printing material in the printing material reservoir 225, the printing material can be more fully utilized by allowing the remaining amount of printing material to flow through the channel 215 to the print nozzles 115 that might otherwise be prevented from flowing due to the back pressure.

In some example implementations, the channel 215, or other element of the housing 205, can include a printing material level sensor to determine when the printing material has been depleted past a threshold level. Because the pressure equalization element 120 is coupled to the printing material reservoir 225 by a separate channel 220, an air bubble formed in channel 220 to equalize the back pressure does not interfere with the functionality of the printing material level sensor.

Figure 3:
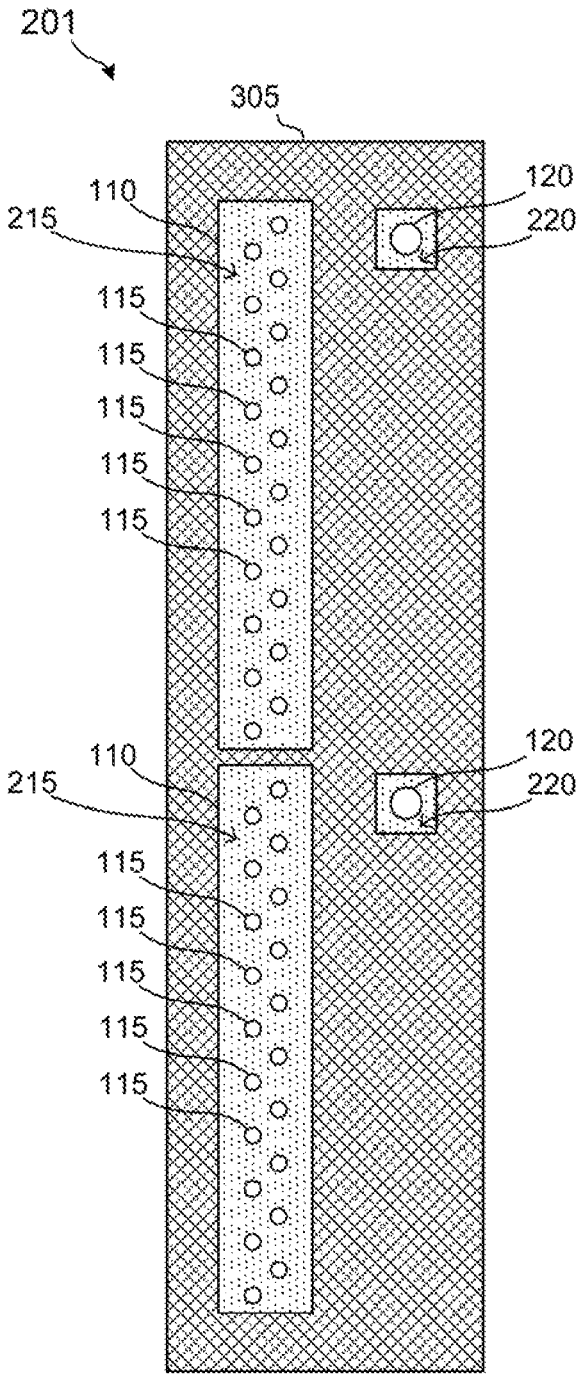
FIG. 3 depicts a schematic of an example over-molded printhead with pressure equalization elements.

FIG. 3 depicts a view 201 of an example housing 305 according to an implementation of the present disclosure that includes multiple print nozzle arrays 110. For example, multiple print nozzles arrays 110 can be aligned or staggered to form a page wide array printhead to print across the width of a page of print media in one pass without scanning the printhead. Each of the multiple print nozzle arrays can be included in an inkjet die coupled to corresponding separate printing material reservoirs by corresponding separate channels 215. Similarly, each separate printing material reservoir can be coupled to a corresponding pressure equalization element 120 by corresponding channel 220. In such implementations, the separate printing material reservoirs can store and dispense printing materials through the corresponding channels 215 and print nozzles 115. The separate printing material reservoirs can be coupled to one another by additional pressure equalization or printing material distribution valves disposed between the reservoirs.

Figure 4:
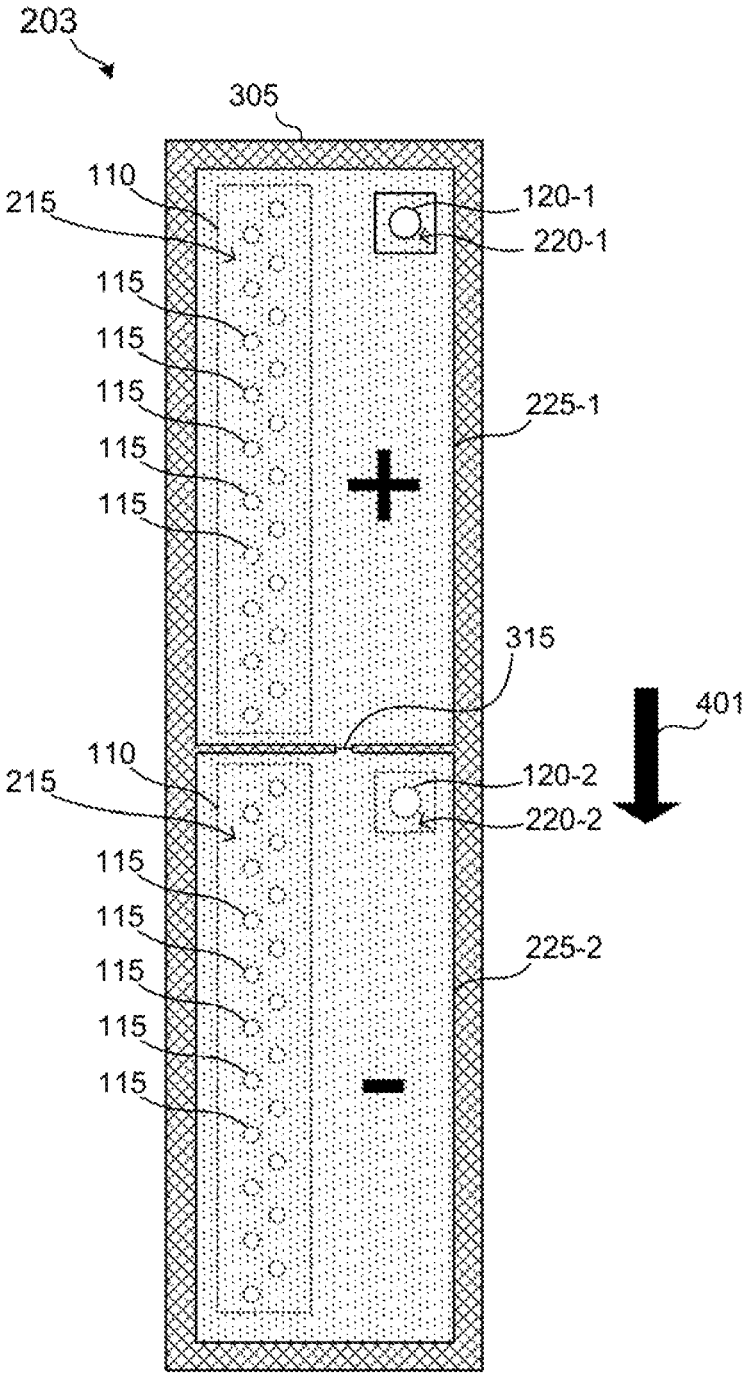
FIG. 4 depicts a schematic of an example over-molded printhead with multiple reservoirs and pressure equalization elements.

FIG. 4 depicts a view 203 of the example housing 305 in which the printing material reservoirs 225 are shown as being connected by a corresponding pressure equalization valve 315. In scenarios in which printing material is ejected faster by one print nozzle array 110 than another print nozzle array 110, printing material can flow from one printing material reservoir 225 to another printing material reservoir 225. Such implementations help ensure that one printing material reservoir coupled to a particular array of print nozzles 115 does not run dry before other printing material reservoirs 225 have been depleted. For example, in the scenario in which the printing material in the printing material reservoir 225-2 is depleted at a rate faster than the printing material in the printing material reservoir 225-1, the lower pressure in the printing material reservoir 225-2 can cause the printing material to move in the direction indicated by the arrow 401. Thus, printing material can flow through the valve 315 from the printing material reservoir 225-1 to the printing material reservoir 225-2 once the difference in pressure between the two reservoirs is greater than a threshold difference.

The pressure equalization mechanism of moving the printing material from one printing material reservoir 225 to another printing material reservoir 225 can augment or supplement the functionality of the pressure equalization elements 120. For example, the pressure differential threshold of valve 315 between printing material reservoirs 225 can be lower than, equal to, or greater than the pressure differential required to activate the pressure equalization element 120. Thus, printing material can be distributed amongst the printing material reservoirs 225 before, during, or after air is allowed to enter through the pressure equalization element 120.

These and other variations, modifications, additions, and improvements may fall within the scope of the appended claims(s). As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise. All of the features disclosed in this specification (including any accompanying claims, abstract and drawings), and/or all of the elements of any method or process so disclosed, may be combined in any combination, except combinations where at least some of such features and/or elements are mutually exclusive.

What is claimed is:

1. A printhead assembly comprising:

a housing having a first printing material reservoir and a second printing material reservoir;

a print nozzle array disposed in a side of the housing and coupled to each respective printing material reservoir through an array channel including the print nozzle array; and a pressure equalization channel disposed in each of the respective printing material reservoirs to allow air to enter each respective printing material reservoir when a pressure in the respective printing material reservoir changes.

2. The printhead assembly of claim 1, wherein the print nozzle array is disposed in a first region of the housing and the pressure equalization channel is disposed in a second region of the housing.

3. The printhead assembly of claim 2, wherein the first region is displaced from the second region by a particular distance to prevent occlusion of printing material between the first and second regions.

4. The printhead assembly of claim 1, wherein the first printing material reservoir is coupled to the second printing material reservoir through a corresponding different pressure equalization channel to equalize pressures across the plurality of reservoirs.

5. The printhead assembly of claim 1, wherein the print nozzle array comprises an array of nozzles disposed in a semiconductor material, the housing comprises a plastic material, and includes a lateral portion of plastic material disposed between the first printing material reservoir and the second printing material reservoir.

6. The printhead assembly of claim 5, wherein the print nozzle array includes a different pressure equalization channel defined by an opening in the lateral portion of the plastic material, wherein the different pressure equalization channel permits printing material to pass through the different pressure equalization channel to equalize pressures between the first printing material reservoir and the second printing material reservoir.

7. The printhead assembly of claim 1, wherein the pressure equalization channel includes a passive bubbler.

8. The printhead assembly of claim 1, further including a corresponding duct defined by an over-molded portion of the housing couples each respective printing material reservoir to an associated pressure equalization channel.

9. A printhead comprising:

a plurality of print nozzle arrays; and an over-molded housing including the plurality of print nozzle arrays to extend a perimeter of the plurality of print nozzle arrays, wherein the over-molded housing includes:

a corresponding printing material reservoir for each respective print nozzle array;

a corresponding pressure equalization channel coupled to a respective printing material reservoir by a duct, wherein the duct is defined by the over-molded housing; and wherein each respective printing material reservoir is coupled to one of the plurality of print nozzle arrays by a channel included in the corresponding print nozzle array.

10. The printhead of claim 9, wherein each corresponding printing material reservoir is coupled to at least one other printing material reservoir in the printhead by a different pressure equalization channel.

11. The printhead of claim 10, wherein the different pressure equalization channel includes a pressure-sensitive valve.

12. The printhead of claim 9, wherein each respective pressure equalization channel permits air to enter the corresponding printing material reservoir when a pressure in the respective printing material reservoir changes.

13. A printhead comprising:

an over-molded housing including a first printing material reservoir and a second printing material reservoir;

a first print nozzle array coupled to the first printing material reservoir and a second print nozzle array coupled to the second printing material reservoir;

a lateral portion of the housing disposed between the first printing material reservoir and the second printing material reservoir; and a first pressure equalization channel disposed in the lateral portion of the housing to equalize pressures across the first and second printing material reservoirs.

14. The printhead of claim 13, wherein the first pressure equalization channel is to equalize pressure across the first and second printing material reservoirs responsive to depletion of printing material from the first printing material reservoir through its corresponding print nozzle array at a faster rate than depletion of printing material from the second printing material reservoir.

15. The printhead of claim 13, wherein the first pressure equalization channel is to equalize pressure across the first and second printing material reservoirs responsive to a difference in pressure between the first printing material reservoir and the second printing material reservoir.

16. The printhead of claim 15, wherein the first pressure equalization channel permits the passage of printing material between the first printing material reservoir and the second printing material reservoir responsive to the difference in pressure exceeding a threshold amount.

17. The printhead of claim 13, wherein the first pressure equalization channel is to permit printing material to flow between the first printing material reservoir and the second printing material reservoir responsive to a difference in pressure between the first printing material reservoir and the second printing material reservoir exceeding a first threshold amount, and wherein the printhead further includes:

a second pressure equalization channel disposed in each of the first and second printing material reservoirs to allow air to enter the respective printing material reservoir when a pressure in the respective printing material reservoir reaches a second threshold amount;

wherein the first threshold amount is different than the second threshold amount.

18. The printhead of claim 13, wherein the first pressure equalization channel includes an orifice defined by the lateral portion of the housing.

19. The printhead of claim 13, wherein the first pressure equalization channel includes a pressure-sensitive valve.

* * * * *